US007845977B2

(12) United States Patent
Cook et al.

(10) Patent No.: US 7,845,977 B2
(45) Date of Patent: Dec. 7, 2010

(54) SELF-LOCKING COAXIAL CONNECTORS AND RELATED METHODS

(75) Inventors: Chris Cook, Hickory, NC (US); Ricky Rathbone, Catawba, NC (US)

(73) Assignee: CommScope, Inc. of North Carolina, Hickory, NC (US)

( * ) Notice: Subject to any disclaimer, the term of this patent is extended or adjusted under 35 U.S.C. 154(b) by 47 days.

(21) Appl. No.: 12/419,462

(22) Filed: Apr. 7, 2009

(65) Prior Publication Data

US 2010/0255718 A1 Oct. 7, 2010

(51) Int. Cl.
*H01R 9/05* (2006.01)

(52) U.S. Cl. ..... 439/578

(58) Field of Classification Search ..... 439/578–585
See application file for complete search history.

(56) References Cited

U.S. PATENT DOCUMENTS 5,207,602 A * 5/1993 McMills et al. ..... 439/836
5,609,501 A * 3/1997 McMills et al. ..... 439/578
7,048,579 B2 * 5/2006 Montena ..... 439/578
7,217,155 B2 * 5/2007 Montena ..... 439/578
7,452,237 B1 11/2008 Montena
7,455,549 B2 11/2008 Rodrigues et al.
7,473,128 B2 * 1/2009 Montena ..... 439/584
2004/0209516 A1 10/2004 Burris et al.
2006/0014426 A1 * 1/2006 Montena ..... 439/578

OTHER PUBLICATIONS

European Search Report for corresponding EP application EP10155471.5, dated Aug. 12,2010.

* cited by examiner

*Primary Examiner*—Chandrika Prasad
(74) *Attorney, Agent, or Firm*—Myers Bigel Sibley & Sajovec

(57) ABSTRACT

Coaxial connectors include a connector body that includes a first connector body opening for receiving a coaxial cable. A tubular inner contact post that is at least partly within the connector body is provided. A sliding compression element is also provided that is configured to impart a generally circumferential compressive force to secure one or more elements of the coaxial cable between the sliding compression element and the connector body when an axially directed force that is directed away from the connector body is applied to the coaxial cable.

25 Claims, 9 Drawing Sheets

SELF-LOCKING COAXIAL CONNECTORS AND RELATED METHODS

FIELD OF THE INVENTION

The present invention relates generally to communications systems and, more particularly, to connectors for coaxial cables.

BACKGROUND

Coaxial cables are a specific type of electrical cable that may be used to carry information signals such as television signals or data signals. Coaxial cables are widely used in cable television networks and to provide broadband Internet connectivity. FIGS. 1A and 1B are, respectively, a transverse cross-sectional view and a longitudinal cross-sectional view of a conventional coaxial cable 10 (FIG. 1B is taken along the cross section A-A shown in FIG. 1A). As shown in FIGS. 1A and 1B, the coaxial cable 10 has a central conductor 12 that is surrounded by a dielectric 14. A tape 16 is preferentially bonded to the dielectric 14. The central conductor 12, dielectric 14 and tape 16 comprise the core 18 of the cable. Electrical shielding wires 20 and, optionally, electrical shielding tape(s) 22 surround the cable core 18. Finally, a cable jacket 24 surrounds the electrical shielding wires 20 and electrical shielding tape(s) 22. As shown in FIG. 1B, the dielectric 14, tape 16, electrical shielding wires 20, electrical shielding tape 22 and cable jacket 24 may be cut, and the electrical shielding wires 20, electrical shielding tape 22 and cable jacket 24 may be folded back, in order to prepare the coaxial cable 10 for attachment to certain types of coaxial connectors.

Coaxial connectors are a known type of connector that may be used to connect two coaxial cables 10 or to connect a coaxial cable 10 to a device (e.g., a television, a cable modem, etc.) having a coaxial cable interface. Coaxial "F" connectors are one specific type of coaxial connector that has a male termination.

Standards promulgated by the Society of Cable Telecommunications Engineers ("SCTE") and, more specifically, ANSI/SCTE 99 2004, specify an axial tension pull-off or retention force that a coaxial "F" connector must impart on the coaxial cable onto which it is installed. Specification of this minimum retention force ensures that the connector will resist pulling forces that may be applied to the cable during normal use such that the cable will not readily separate from the coaxial "F" connector. Other ANSI/SCTE standards specify moisture migration parameters, electrical parameters, other mechanical parameters and environmental requirements. Relevant standards documents include the ANSI/SCTE 123 2006, 60, 2004 and 98 2004 standards.

A number of different types of coaxial connector designs are known in the art, including, but not limited to, crimped on connectors, swaged on connectors and connectors which secure the cable into the connector with compression style cable retention elements. With the crimped connector designs, typically a hexagonal-shaped tool is used to crimp a sleeve of the connector onto the coaxial cable that is to be terminated into the connector. With the swaged connector designs, the sleeve of the connector is swaged circumferentially inward so as to reduce it's inside diameter in order to exert the required retention force on the coaxial cable. While compression style cable retention may be suitable regarding retention performance, such techniques may require the use of a compression and/or crimping tool and/or step to secure and/or lock the connector to the cable.

SUMMARY

Some embodiments of the present invention are directed to self-locking coaxial connectors. Embodiments of a coaxial connector as described herein include a connector body including a first connector body opening for receiving a coaxial cable and a tubular inner contact post that is at least partly within the connector body. Some embodiments include a sliding compression element that is configured to impart a compressive force to secure one or more elements of the coaxial cable between the sliding compression element and the connector body when an axially directed force that is directed away from the connector body is applied to the coaxial cable. In some embodiments the compressive force comprises a generally circumferential compressive force.

Some embodiments provide that the sliding compression element is further configured to limit the compressive force to one or more non-core elements of the coaxial cable.

Some embodiments may include a mechanical fastening element that includes an internal threaded portion, that is attached proximate a second connector body opening that is opposite the first connector body opening. The mechanical fastening element may be rotationally independent relative to the connector body and may be configured to be rotationally engaged with a complementary external threaded portion of another connector.

In some embodiments, the sliding compression element includes an inner surface that is configured to axially moveably engage an outer surface of the tubular inner contact post. Some embodiments provide that the sliding compression element includes a wedge portion that is configured to apply circumferential pressure to the one or more elements of the coaxial cable in a radially outward direction. In some embodiments, the wedge portion includes a radially consistent wedge that includes a compression element opening that is configured to receive a first portion of the coaxial cable. Some embodiments provide that the wedge portion includes an outer surface that is configured to engage a second portion of the coaxial cable when the compression element opening receives the first portion of the coaxial cable.

In some embodiments, the sliding compression element includes an inside surface and an outside surface. The outside surface may include a first compression surface including a variable distance from an axially oriented centerline of the connector. The inside surface may be configured to receive the inner contact post in a slidable engagement. Some embodiments provide that the compression surface includes a first end that is a first distance from the axially oriented centerline that corresponds to the first connector body opening and a second end that is a second distance from the axially oriented centerline, wherein the first distance is less than the second distance.

Some embodiments provide that the variable distance is substantially linear and includes a cross-sectional profile that defines a retention surface angle relative to the axially oriented centerline. In some embodiments, the retention surface angle is about 5 to about 15 degrees relative to the axially oriented centerline. In some embodiments, the connector body includes a second compression surface that is configured to be substantially parallel to the first compression surface to define a cable retention gap. Some embodiments provide that when the first connector body opening receives the coaxial cable, the sliding compression element is configured to slide away from the first connector body opening to increase the cable retention gap and the one or more elements of the coaxial cable are compelled between the first compression surface and the second compression surface. In some embodiments, when the axially directed force that is directed away from the connector body is applied to the coaxial cable, the sliding compression element is configured to slide towards the first connector body opening to decrease the cable retention gap.

Some embodiments provide that the sliding compression element also includes multiple radially oriented slots in at least a portion of the first compression surface. In some embodiments, the inside surface of the sliding compression element includes a stopping surface that is configured to limit the movement of the sliding compression element in a direction away from the first connector body opening. Some embodiments provide that the sliding compression element is entirely within the connector body.

Some embodiments of the present invention include a coaxial connector that includes a sliding compression element located within a connector body and configured to impart a compressive force to secure one or more elements of a coaxial cable between a sliding compression element tapered outer surface and a connector body tapered inner surface when an axially directed force that is directed away from the connector body is applied to the coaxial cable.

In some embodiments, the sliding compression elements is further configured to limit the compressive force to one or more non-core elements of the coaxial cable.

In some embodiments, the sliding compression element includes a plurality of radially oriented slots in at least a portion of the sliding compression element tapered surface. In some embodiments, the sliding compression element includes an inner surface that is configured to receive a first portion of the coaxial cable and the tapered surface is configured to engage the one or more elements of the coaxial cable that are different from the first portion of the coaxial cable.

Some embodiments provide a tubular inner contact post that includes a contact inner surface that is configured to receive the first portion of the coaxial cable and a contact outer surface that is configured to receive the sliding compression element. Some embodiments provide that the sliding compression element is configured to slide relative to the tubular inner contact post. In some embodiments, the sliding compression element includes a stopping surface that is configured to engage a portion of the tubular inner contact post to limit travel of the sliding compression element relative to the tubular inner contact post.

Some embodiments include a mechanical fastener that is configured to be engaged with a complementary portion of another connector.

In some embodiments, the sliding compression element tapered outer surface includes a surface angle that is substantially 10 degrees relative to an axially oriented centerline.

Some embodiments of the present invention include methods of using a self-locking coaxial connector. Such methods may include inserting a prepared end of a coaxial cable in an axial direction into a first end of the coaxial connector to position one or more elements of the coaxial cable between a tapered surface of a sliding compression element and a tapered surface of a connector body. Such methods may include applying an axially directed force to the coaxial cable that is directed away from the coaxial connector to cause the one or more elements of the coaxial cable to be compressed between the tapered surface of the sliding compression element and the tapered surface of the connector body via the axial motion of the sliding compression element.

In some embodiments, the one or more elements of the coaxial cable comprise non-core elements of the coaxial cable and a core section of the coaxial cable is not compressed.

DETAILED DESCRIPTION

Figure 1A:
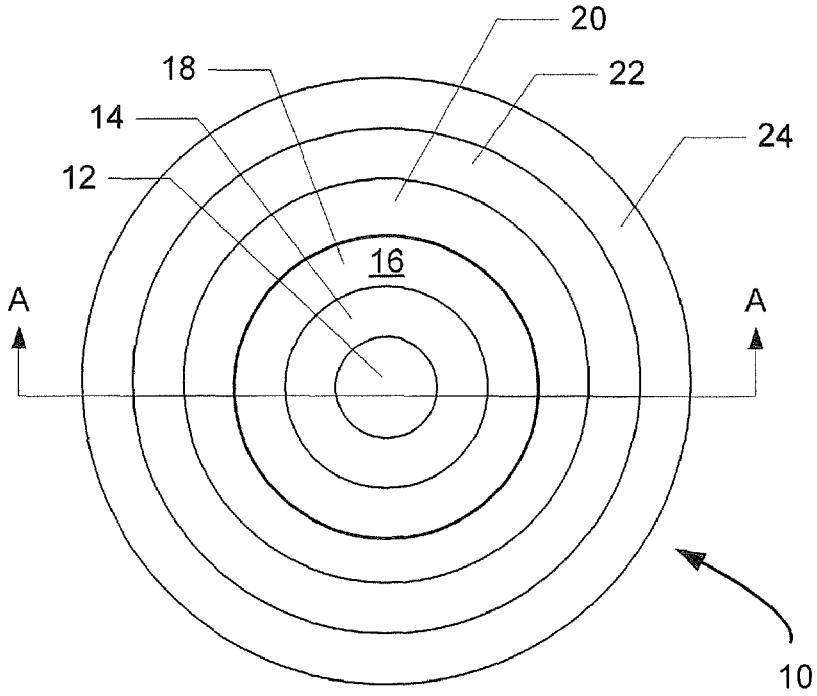
FIG. 1A (Prior Art)
FIGS. 1A and 1B are, respectively, a transverse cross-sectional diagram and a longitudinal cross-sectional diagram of a conventional coaxial cable.
Figure 1B:
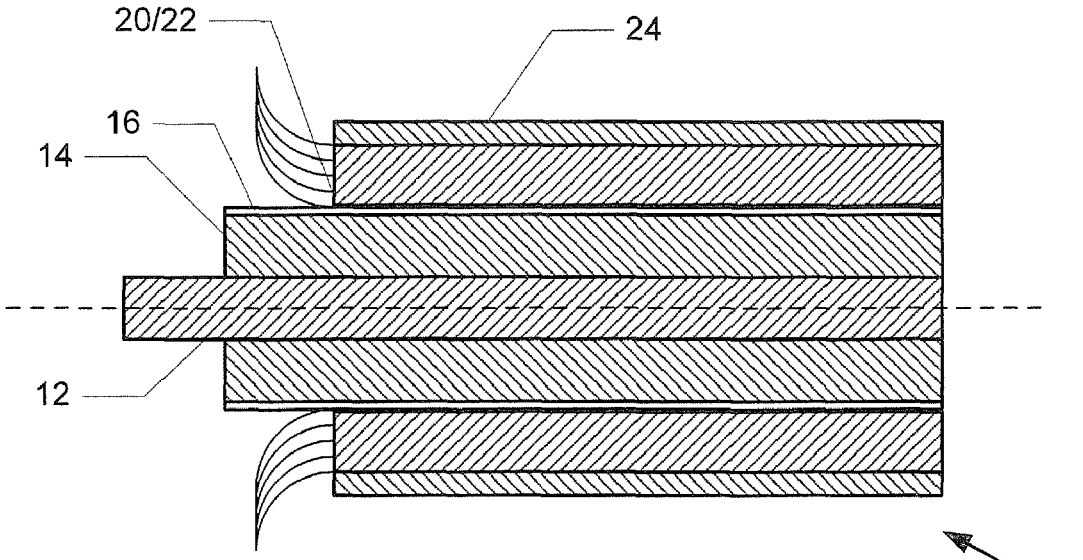
FIG. 1B (Prior Art)

The present invention now is described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

In the drawings, the size of lines and elements may be exaggerated for clarity. It will also be understood that when an element is referred to as being "coupled" to another element, it can be coupled directly to the other element, or intervening elements may also be present. In contrast, when an element is referred to as being "directly coupled" to another element, there are no intervening elements present. Likewise, it will be understood that when an element is referred to as being "connected" or "attached" to another element, it can be directly connected or attached to the other element or intervening elements may also be present. In contrast, when an element is referred to as being "directly connected" or "directly attached" to another element, there are no intervening elements present. The terms "upwardly", "downwardly", "front", "rear" and the like are used herein for the purpose of explanation only.

Unless otherwise defined, all technical and scientific terms used herein have the same meaning as commonly understood by one of ordinary skill in the art to which this invention belongs. The terminology used in the description of the invention herein is for the purpose of describing particular embodiments only and is not intended to be limiting of the invention. As used in the description of the invention and the appended claims, the singular fauns "a", "an" and "the" are intended to include the plural forms as well, unless the context clearly indicates otherwise. As used herein, the term "and/or" includes any and all combinations of one or more of the associated listed items.

Pursuant to embodiments of the present invention, self-locking coaxial connectors are provided that include a sliding compression element within a connector body that imparts a compressive and/or seizing force to secure one or more elements of a coaxial cable to the self-locking coaxial connector. The sliding compression element and connector body may each include substantially complementary tapered surfaces between which coaxial cable elements may be compressed and/or seized. When a prepared coaxial cable is inserted into the self-locking coaxial connector, the sliding compression element slides to a position that increases a distance between the complementary tapered surfaces, thereby allowing the prepared coaxial cable to be received into the self-locking coaxial connector. After the coaxial cable is fully inserted into the self-locking coaxial connector, when the coaxial cable is pulled away from the self-locking coaxial connector, the sliding compression element slides towards a position that decreases the distance between the complementary tapered surfaces, thereby imparting a compressive and/or seizing force to secure one or more elements of the coaxial cable. In this manner, the self-locking coaxial connector may be installed on a coaxial cable without the use of compression and/or crimping tools as described above in the Background. Some embodiments provide that the compressive and/or seizing force that secures the one or more elements of the coaxial cable may be limited to non-core portions of the coaxial cable. In this manner, compression of the core portions of the coaxial cable may be avoided, thus potentially reducing the possibility of adversely affecting the electrical performance of the connector/cable interface.

Figure 2A:
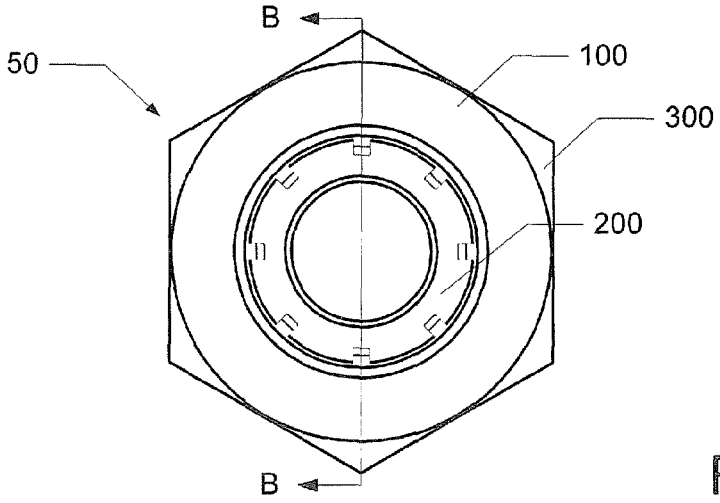
FIGS. 2A, 2B, 2C and 2D are an end view, side view, a cut-away side view with the sliding compression element in a first position and a cut-away side view with the sliding compression element in a second position, respectively, of a self-locking coaxial connector according to some embodiments of the present invention.
Figure 2B:
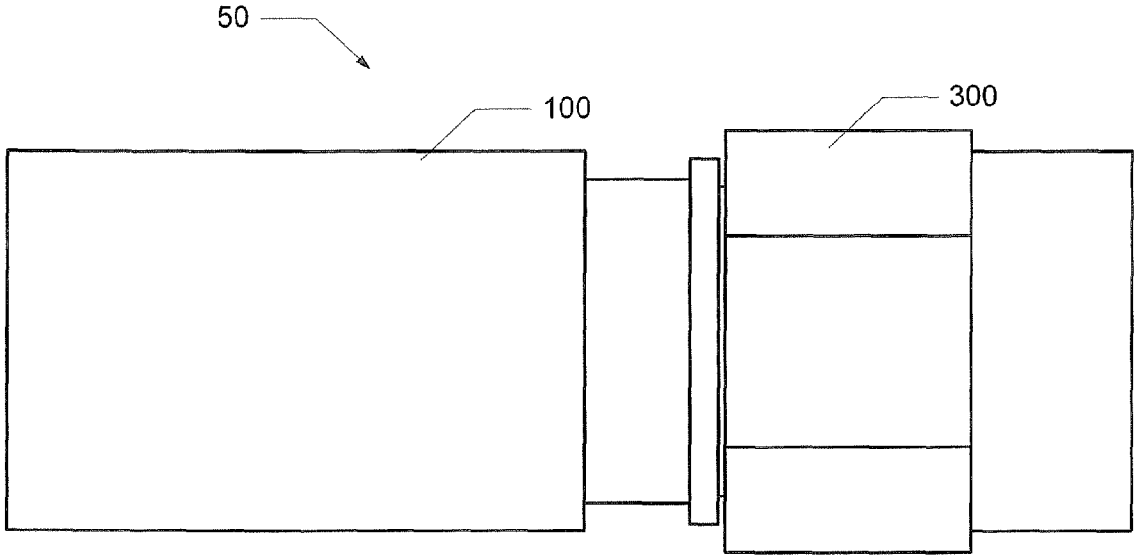
Figure 2C:
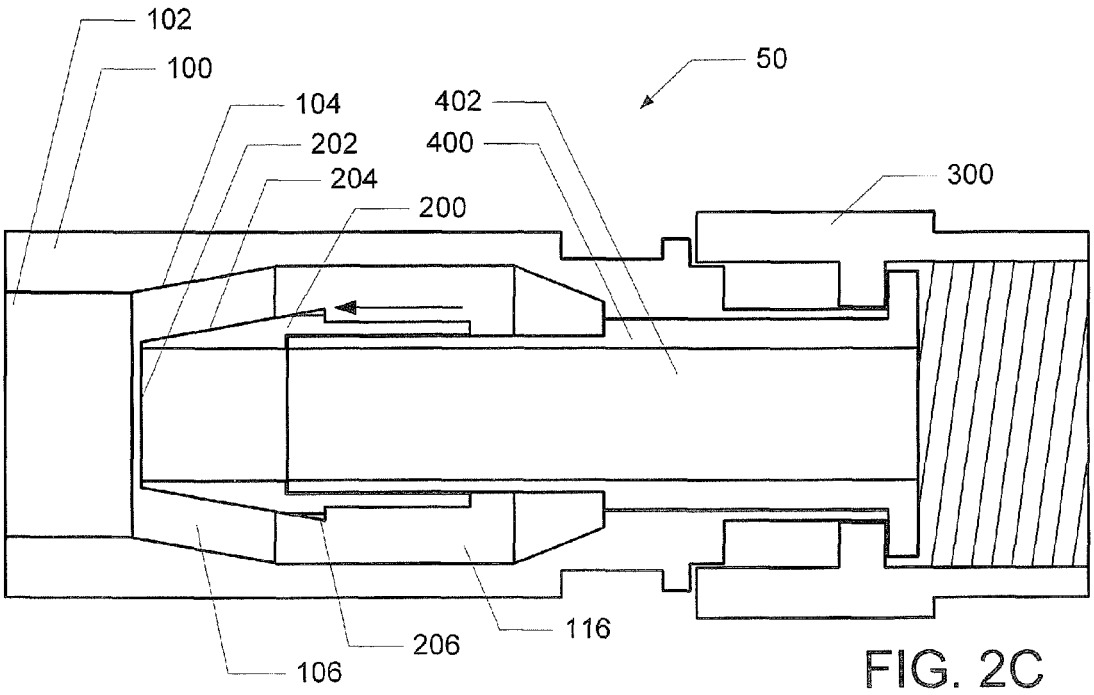

Reference is now made to FIGS. 2A, 2B, 2C and 2D, which are an end view, side view, a cut-away side view with the sliding compression element in a first position and a cut-away side view with the sliding compression element in a second position, respectively, of a self-locking coaxial connector according to some embodiments of the present invention. Referring to FIG. 2C, which is taken along the cross section B-B shown in FIG. 2A, a self-locking coaxial connector 50 includes a connector body 100 that includes a first opening 102 that is configured to receive a prepared coaxial cable 10. The connector 50 includes a contact post 400 that is configured to be coupled to the connector body 100 and to receive, for example, a core 18 of the coaxial cable 10 into a contact post interior space 402.

The connector 50 includes a sliding compression element 200 that is configured to impart, in conjunction with connector body 100, a compressive force on one or more elements of the coaxial cable 10 when the coaxial cable 10 is pulled away from the connector 50. The connector 50 may also include a mechanical fastening element 300 that is rotatably attached to the connector body 100 and is configured to engage a portion of another connector (not shown).

In use and operation, as the prepared coaxial cable 10 is inserted into the first opening 102 of the connector body 100, a leading edge 202 of the sliding compression element 200 in a first position may be inserted between a core portion 18 of the coaxial cable 10 and one or more outer portions (20, 22, 24) of the coaxial cable 10. Some embodiments provide that the coaxial cable 10 pushes the sliding compression element 200 into the first position as the coaxial cable 10 is inserted into the first opening 102 of the connector body 100. In this regard, the sliding compression element 200 may be in any position prior to the insertion of the coaxial cable 10. In some embodiments, the sliding compression element 200 may include a substantially wedge-shaped profile that may be configured to apply circumferential pressure to the one or more outer portions (20, 22, 24) of the coaxial cable 10 in a radially outward direction. In this regard, some embodiments provide that compression of the core portions (18) of the coaxial cable 10 may be avoided. By not compressing the core portions (18) of the coaxial cable, adverse impacts on the electrical performance of the connector/cable interface may be avoided.

As the prepared coaxial cable 10 is pushed into the connector body 100, one or more of the outer portions (20, 22, 24) of the coaxial cable 10 may be directed into a cable retention gap 106 that is between a compression surface 204 of the sliding compression element 200 and a compression surface 104 of the connector body 100. In some embodiments, the compression surface 104 and 204 may be radial compression surfaces that are configured to cause a substantially radially directed compression. As the prepared coaxial cable is pushed further into the connector body 100, the one or more outer portions (20, 22, 24) may be compelled into a connector body cavity 116 that is configured to receive portions of the coaxial cable 10.

Figure 2D:
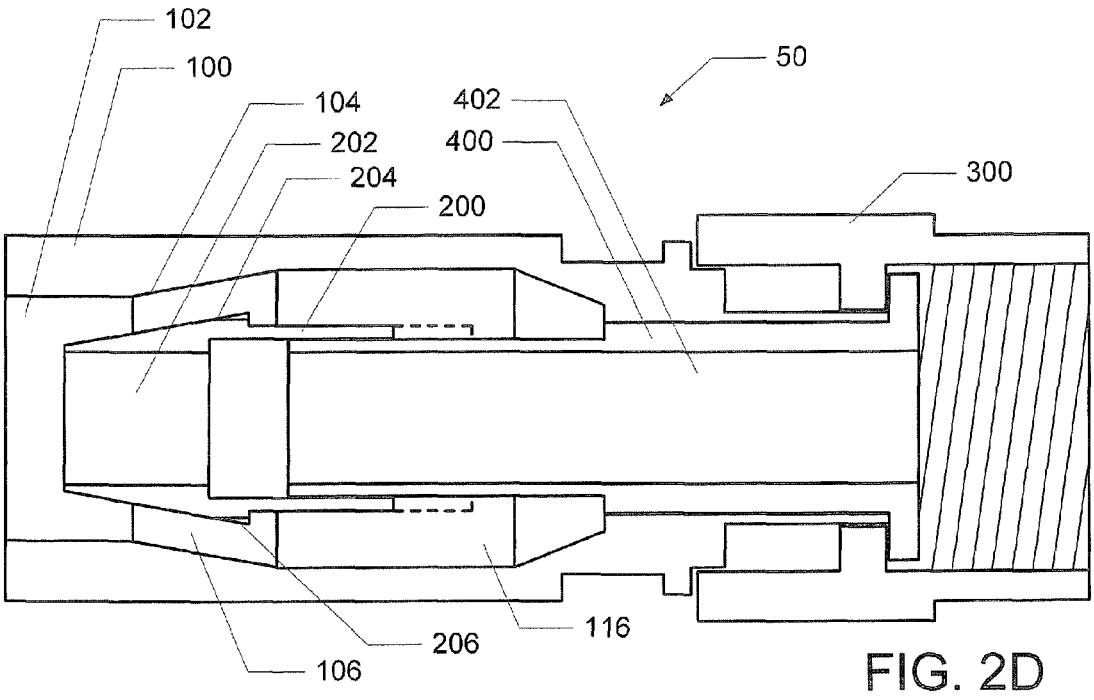

Referring to FIG. 2D, once the prepared coaxial cable 10 is inserted into the connector body 100, when an axially directed force that is directed away from the connector body 100 is applied to the coaxial cable 10, the one or more outer portions (20, 22, 24) of the coaxial cable 10 that are engaged with the sliding compression element 200, cause the sliding compression element 200 to slide along the contact post 400 in the direction of the force. As the sliding compression element 200 slides along the contact post 400, the retention gap 106 between the compression surfaces 104 and 204 decreases (compare FIGS. 2C and 2D), which imparts a generally circumferential compressive force on the one or more outer portions (20, 22, 24) of the coaxial cable 10 to secure the coaxial cable 10 to the connector 50.

Some embodiments provide that the sliding compression element is completely within the connector body 100 in the first position, as illustrated in FIG. 2C. In some embodiments, the sliding compression element 200 is completely within the connector body 100 in the second position, as illustrated in FIG. 2D.

Some embodiments provide that the sliding compression element 200 contacts the contact post 400 in a slidable fashion. In some embodiments, the sliding compression element 200 and/or the contact post 400 may include one or more stops to prevent the sliding compression element 200 from becoming disengaged from the contact post 400. In some embodiments, the sliding compression element 200 may be configured to slide off of the contact post 400 in the direction of the first opening 102 of the connector body 100.

Figure 3A:
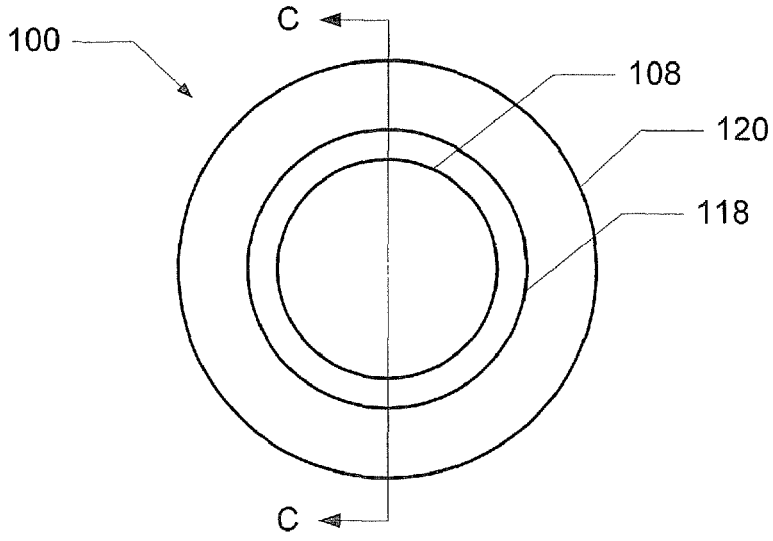
FIGS. 3A, 3B, 3C and 3D are an end view, side view and first and second cut-away side views, respectively, of a connector body of a self-locking coaxial connector according to some embodiments of the present invention.
Figure 3B:
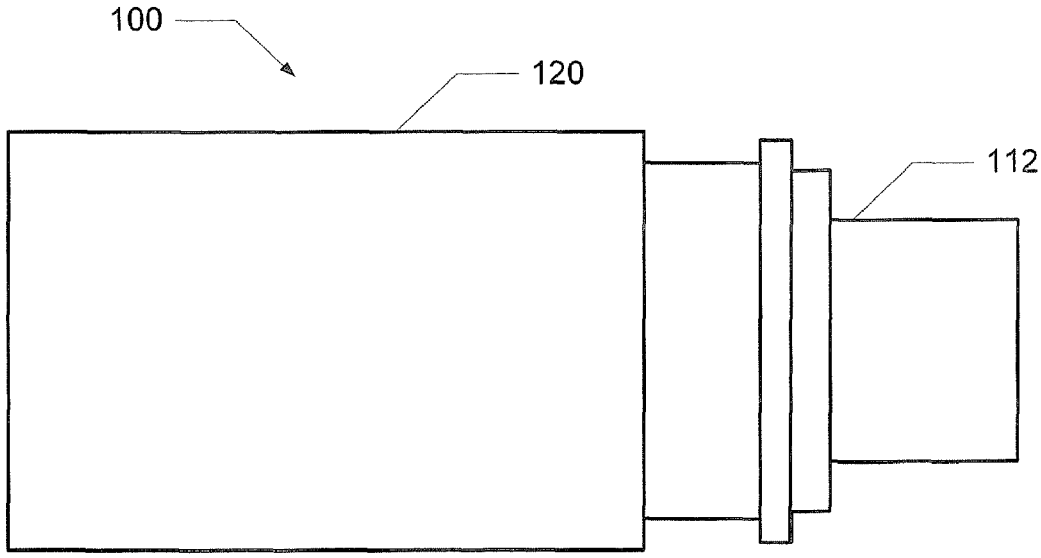
Figure 3C:
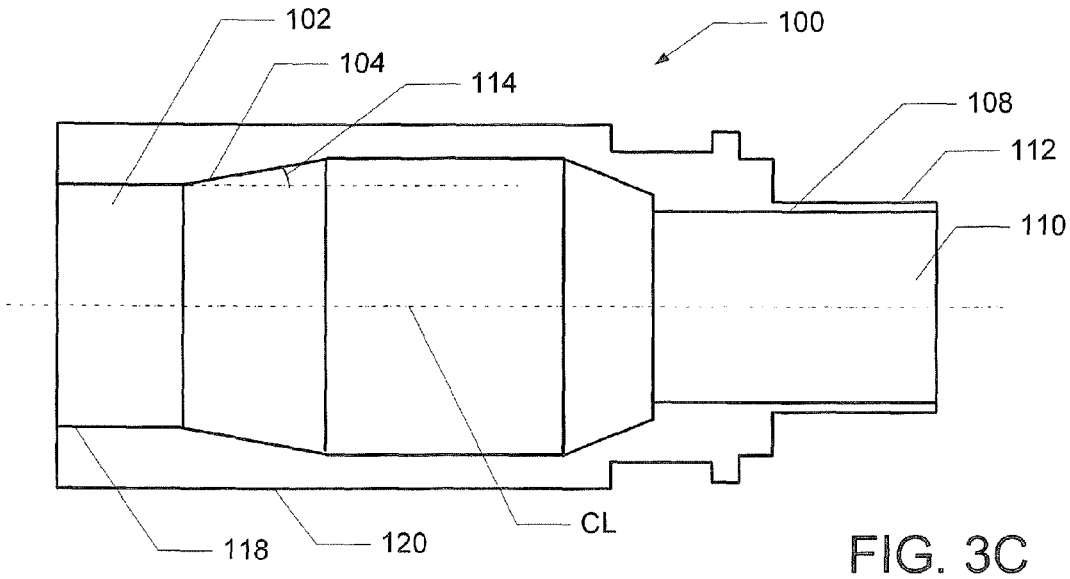

Reference is now made to FIGS. 3A, 3B, 3C, and 3D, which are an end view, side view and cut-away side views, respectively, of the connector body 100 of the self-locking coaxial connector 50. Referring to FIG. 3C, which is taken along the cross section C-C of FIG. 3A, the connector body 100 includes a first opening 102 that is operable to receive the prepared end of a coaxial cable 10. The coaxial cable 10 may be prepared, for example, using a dedicated tool that removes one or more elements of the coaxial cable at specific distances from the end of the cable 10 and/or may be prepared manually using one or more cable cutting and/or stripping tools. The connector body 100 may include a first inner surface 118 that defines the first opening 102.

Figure 3D:
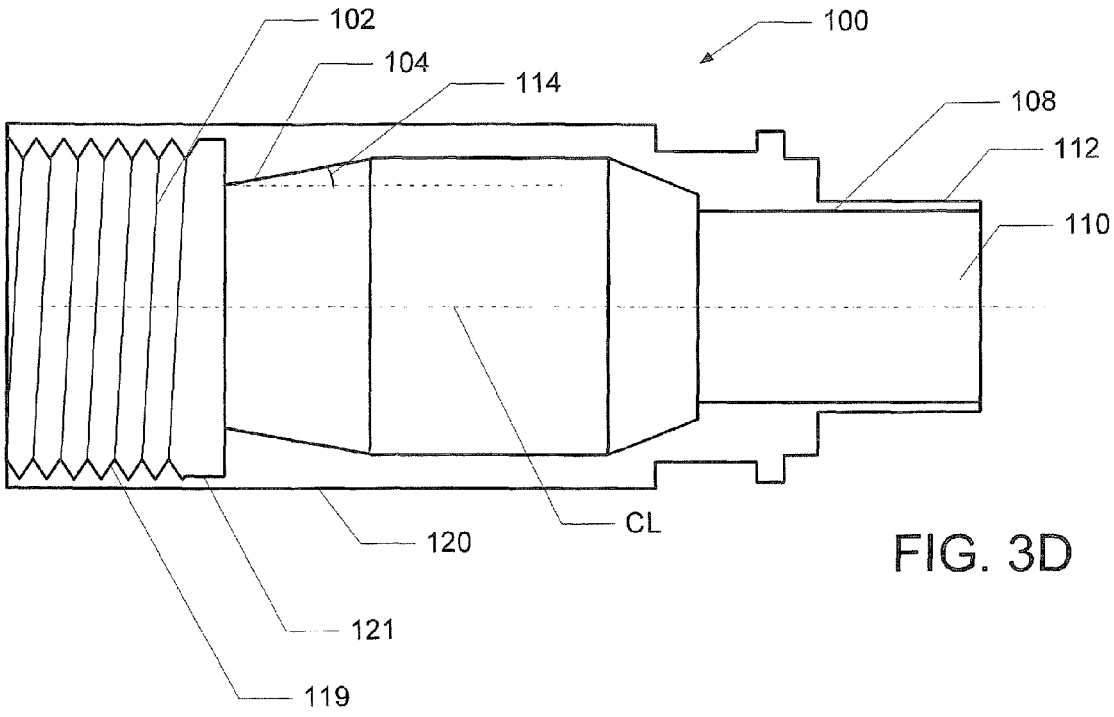

Referring briefly to FIG. 3D, in some embodiments, the first opening 102 may include an internally threaded portion 119 that is configured to threadably engage an out surface of the coaxial cable 10. For example, the connector body 100 may be turned relative to the coaxial cable 10 to engage an exterior surface of the coaxial cable 10 thereby inserting the coaxial cable 10 into the connector body 100 with reduced insertion force.

The connector body 100 may include a first outside surface 120 that may include a generally cylindrical geometry. However, the first outer surface 120 is not so limited. For example, in some embodiments the outer surface 120 may include a polygonal and/or other shaped geometry (not shown).

The connector body 100 may include a second opening 110 that is opposite the first opening 102. The connector body 100 may include a second inner surface 108 that defines the second opening 110. The second opening 110 may be configured to receive a contact post 400 as discussed above with respect to FIGS. 2A-2D and discussed in additional detail below with respect to FIGS. 4A-4C.

The connector body 100 may include a fastener mounting surface 112 that is configured to receive a mechanical fastening element 300. As illustrated in FIG. 2C, for example, the mechanical fastening element 300 may be installed on the connector body 100 before the contact post 400 is installed into the second opening 110. The mechanical fastening element 300 may be retained by the contact post 400.

The connector body 100 may include a compression surface 104 that includes a cross-sectional profile having an angle 114 relative to an axially oriented centerline CL. In some embodiments, the angle may be referred to as a retention surface angle 114 and may include an angle between about 5 and about 15 degrees. Some embodiments provide that the retention surface angle 114 may be approximately 10 degrees.

In some embodiments, the compression surface 104 may include a non-linear cross-sectional profile. For example, some embodiments provide that the compression surface 104 includes a curved and/or a curvilinear cross-sectional profile. In some embodiments, the compression surface 104 includes one or more steps that are configured to transition from a first inner diameter to a second inner diameter. Referring to FIG. 3D, some embodiments may include a thread relief portion 121 between the internally threaded portion 119 and the compression surface 104.

Figure 4A:
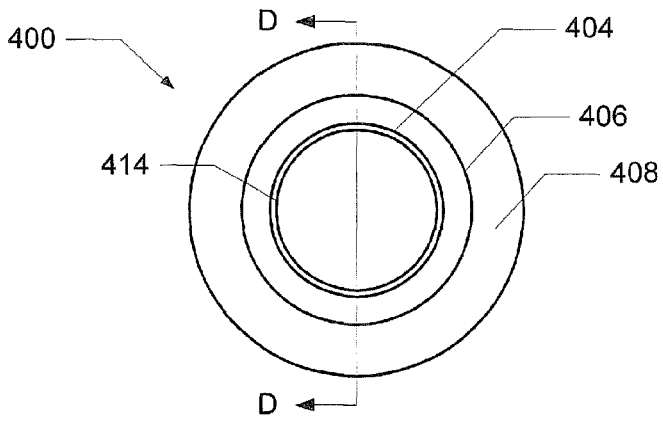
FIGS. 4A, 4B and 4C are an end view, side view and cut-away side view, respectively, of a contact post of a self-locking coaxial connector according to some embodiments of the present invention.
Figure 4B:
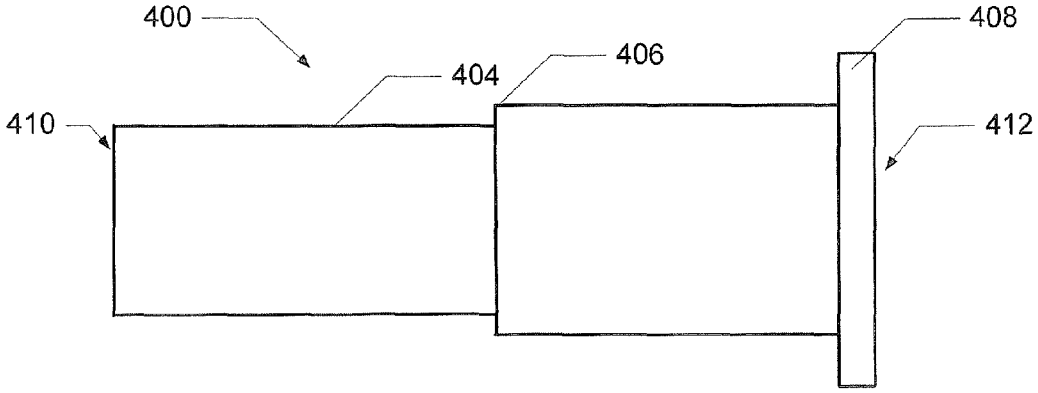
Figure 4C:
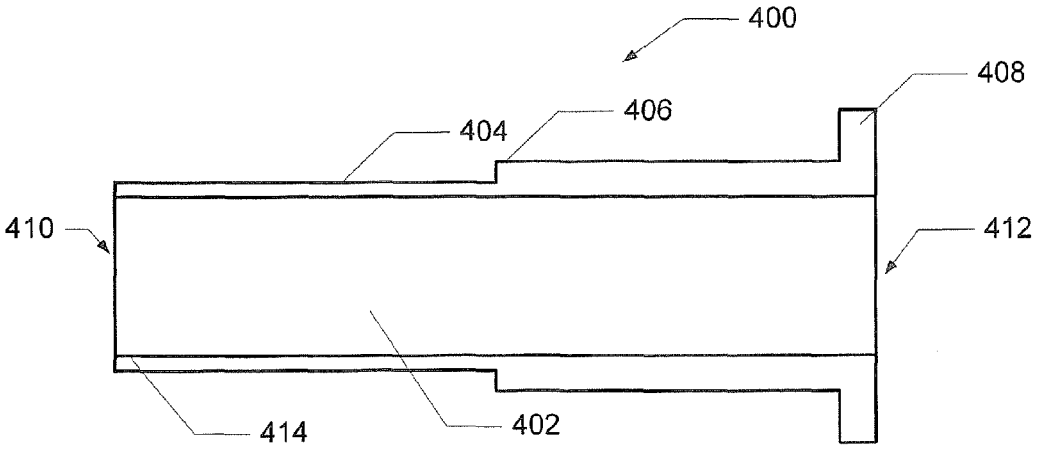

Reference is now made to FIGS. 4A, 4B and 4C, which are an end view, side view and cut-away side view, respectively, of the contact post 400 of the self-locking coaxial connector 50. Referring to FIG. 4C, which is taken along the cross section D-D of FIG. 4A, the contact post 400, which may be referred to as an inner contact post, may be generally tubular and include an inner surface 414 that defines a cavity connecting a contact post first opening 410 and a contact post second opening 412. The contact post first opening 410 may correspond to and be recessed from the first connector body opening 102 that is discussed above with respect to FIGS. 3A-3C. In some embodiments, the contact post first opening 410 may receive a portion of the coaxial cable 10. For example, a core portion 18 of the coaxial cable 10 may be received into the contact post first opening 410 as the prepared coaxial cable 10 is inserted into the first connector body opening 102.

The contact post 400 may include a first contact post outer surface 404 proximate the contact post first opening 410 that is configured to slidably engage a sliding compression element 200, as illustrated in FIGS. 2C and 2D and FIGS. 5A-5C, as discussed below. The contact post 400 may include a second contact post outer surface 406 adjacent the first contact post outer surface 404 that substantially defines a cylinder having a greater diameter than a cylinder defined by the first contact post outer surface 404.

The contact post 400 may include a collar portion 408 that is adjacent the second contact post outer surface 406 and that includes a greater diameter than the contact post outer surface 406. In assembling the self-locking connector 50, mechanical fastening element 300 may be positioned over the fastener mounting surface 112 of the connector body 100 and the contact post 400 may be inserted into the second opening 110 of the connector body 100. In some embodiments, the second contact post outer surface 406 may be press fit in contact with the second inner surface 108 of the connector body 100. In some embodiments, the contact post 400 may be bonded to the connector body 100. The contact post 400 may be inserted into the connector body 100 until the collar portion 408 is in proximity and/or contact with the connector body 100. The diameter of the collar portion 408 may be larger than an opening in the mechanical fastening element 300 in order to retain the same.

Figure 5A:
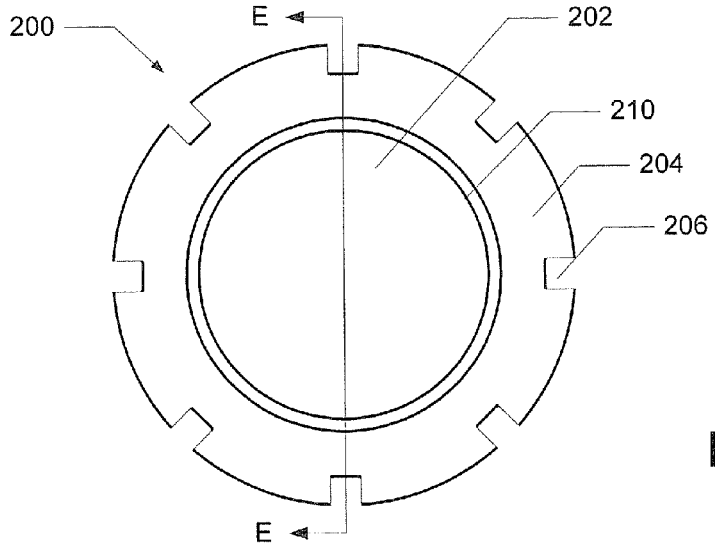
FIGS. 5A, 5B and 5C are an end view, side view and cut-away side view, respectively, of a compression element of a self-locking coaxial connector according to some embodiments of the present invention.
Figure 5B:
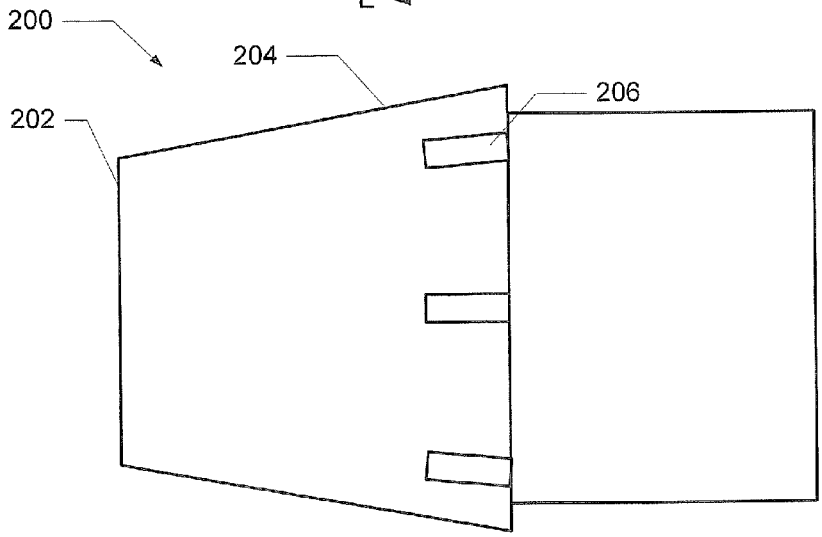
Figure 5C:
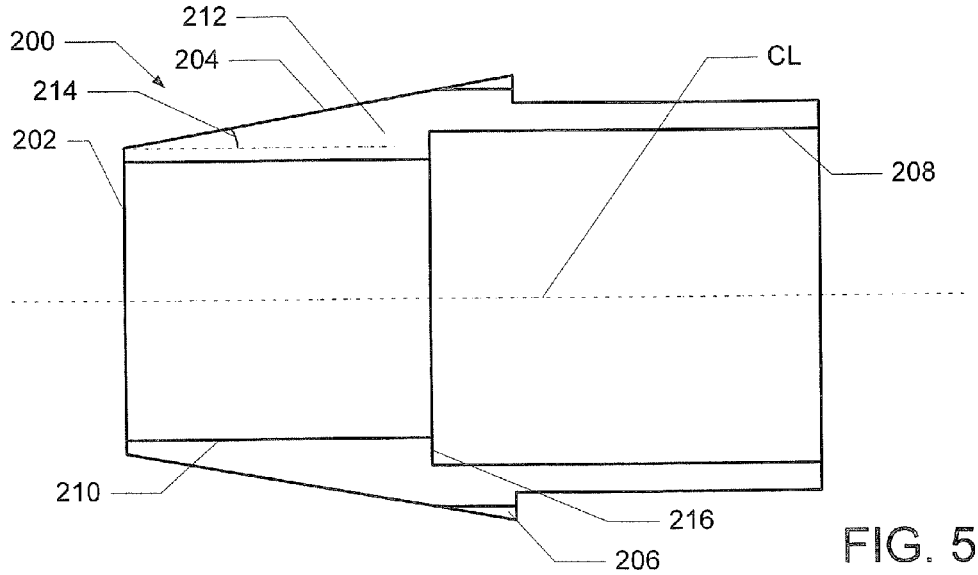

Reference is now made to FIGS. 5A, 5B and 5C, which are an end view, side view and cut-away side view, respectively, of the sliding compression element 200 of the self-locking coaxial connector 50. Referring to FIG. 5C, which is taken along the cross section E-E of FIG. 5A, the sliding compression element 200 may include a first inner surface 208 that is configured to slidably engage the first contact post outer surface 404 within the connector body 100. The sliding compression element 200 may include a wedge portion 212 that is configured to apply circumferential pressure to one or more elements of the coaxial cable in a radially outward direction. The wedge portion 212 may be radially consistent and include a compression element first opening 202 that is configured to receive a core portion 18 of the coaxial cable 10. The wedge portion 212 may further include an outer surface that is configured to engage at least one of the outer portions (20, 22, 24) of the coaxial cable 10 when the compression element first opening 202 receives the core portion 18 of the coaxial cable 10.

Some embodiments provide that the sliding compression element 200 includes an outside surface that includes a compression surface 204 that includes a variable distance from an axially oriented centerline CL of the connector. In some embodiments, the compression surface 204 includes a first end that is a first distance from the axially oriented centerline CL and that corresponds to the compression element first opening 202 and a second end that is a second distance from the axially oriented centerline CL and that is greater than the first distance.

Some embodiments provide that the variable distance is substantially linear and that a cross-sectional profile of the compression surface 204 defines a retention surface angle 214 relative to the axially oriented centerline CL. In some embodiments, the retention surface angle 214 is between about 5 and about 15 degrees. In some embodiments, the retention surface angle 214 is approximately 10 degrees. Some embodiments provide that the retention surface angle 214 of the compression surface 204 is substantially similar to angle 114 of the compression surface 104 such that the compression surfaces 104 and 204 of the connector body 100 and the sliding compression element 200, respectively, may be substantially parallel.

In some embodiments, the compression surface 204 may include a non-linear cross-sectional profile. For example, some embodiments provide that the compression surface 204 includes a curved and/or a curvilinear cross-sectional profile. In some embodiments, the compression surface 204 includes one or more steps that are configured to transition from a first outer diameter to a second outer diameter.

Some embodiments provide that the compression surfaces 104 and 204 are dissimilar in cross-sectional profile. For example, brief reference is made to each of FIGS. 6A-6E, which are partial cut-away side views of respective configurations of compression surfaces of a connector body and compression element of a self-locking coaxial connector.

Figure 6A:
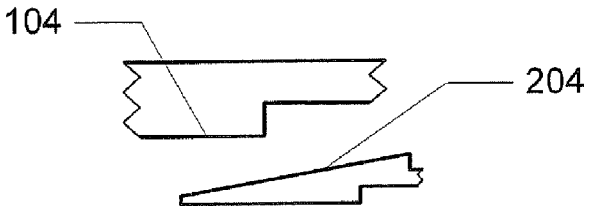
FIGS. 6A-6E are partial cut-away side views of respective configurations of compression surfaces of a connector body and compression element of a self-locking coaxial connector according to some embodiments of the present invention.
Figure 6B:
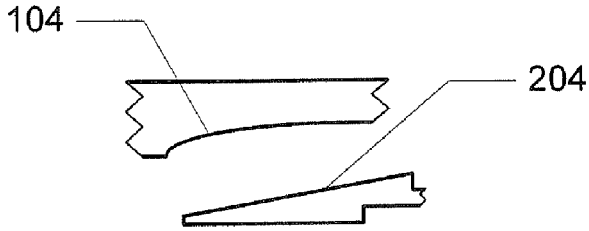
Figure 6C:
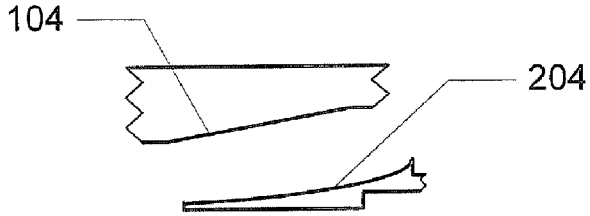
Figure 6D:
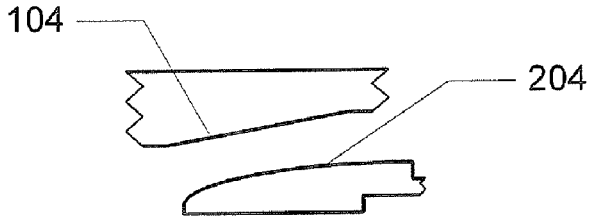
Figure 6E:
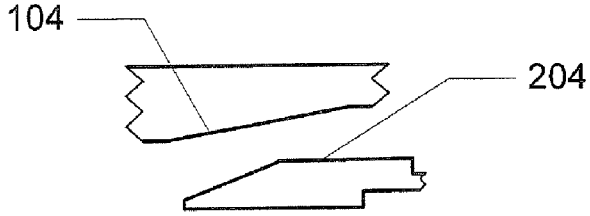

Reference is made to FIG. 6A, which illustrates a connector body compression surface 104 including a step transition from a first inner diameter to a second inner diameter and a sliding compression element compression surface 204 that includes a substantially linear cross section. FIG. 6B illustrates a connector body compression surface 104 that includes a curved cross section and a sliding compression element compression surface 204 that includes a substantially linear cross section. FIG. 6C illustrates a connector body compression surface 104 that includes a substantially linear cross section and a sliding compression element compression surface 204 that includes an inwardly curved cross section. FIG. 6D illustrates a connector body compression surface 104 that includes a substantially linear cross section and a sliding compression element compression surface 204 that includes an outwardly curved cross section. FIG. 6E illustrates a connector body compression surface 104 that includes a substantially linear cross section and a sliding compression element compression surface 204 that includes a substantially linear cross section at an angle that is different from that of the connector body compression element 104. The configurations illustrated in FIGS. 6A-6E are merely exemplary regarding the various configurations and/or combinations thereof and are not exhaustive regarding embodiments described herein.

In some embodiments, the sliding compression element 200 may include one or more radially oriented slots 206 in at least a portion of the compression surface 204. Embodiments herein include slots that may have any one and/or combination of a wide variety of cross-sections. In some embodiments, the radially oriented slots 206 may be substantially parallel to the axially oriented centerline CL of the sliding compression element. The slots 206 may provide a surface irregularity in which one or more of the outer portions (20, 22, 24) of the coaxial cable 10 may expand and/or grip onto to provide frictional engagement for gripping the sliding compression element 200 when the coaxial cable portions (20, 22, 24) are compelled over the slots 206. In this manner, when an axial force is applied to the coaxial cable 10 in the direction away from the connector 50, the coaxial cable 10 may compel the sliding compression element 200 towards the first connector body opening 102, which may decrease the size of the retention gap 106 (FIG. 2D). In this manner, the coaxial cable 10 may be retained by a compressive force in the retention gap 106 between the compression surfaces 104 and 204 without the application of any tools to the self-locking coaxial connector. In some embodiments, multiple radially oriented slots 206 may be provided at different intervals around the radius of the compression surface 204.

In some embodiments, the sliding compression element may include a slide stopping surface 216 that is configured to limit the movement of the sliding compression element 200 in a direction away from the first connector body opening 102. Some embodiments provide that the slide stopping surface may be a step formed as the transition from the first inner surface 208 and the second inner surface 210.

Figure 7:
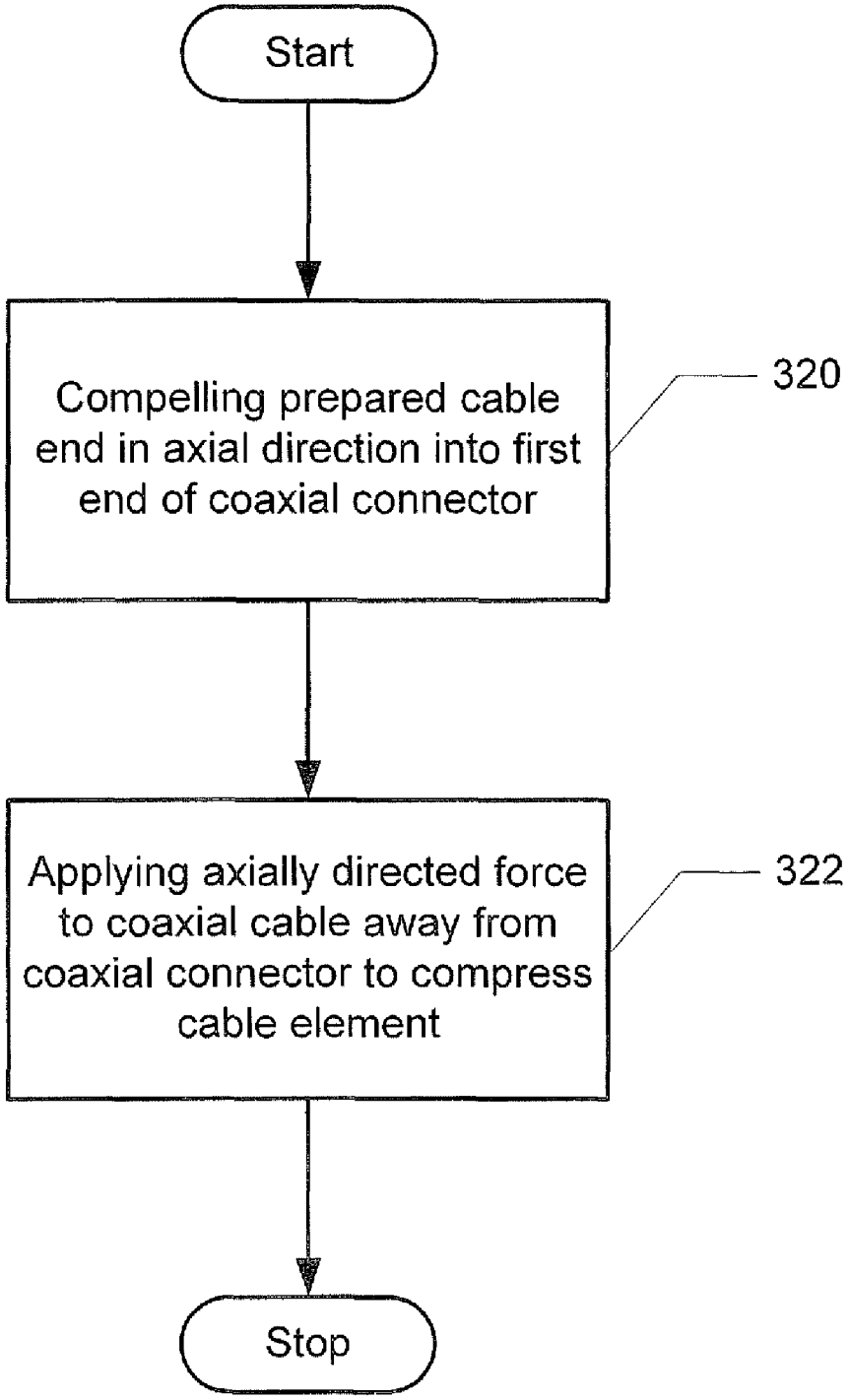
FIG. 7 is a block diagram illustrating a method of using a self-locking coaxial connector according to some embodiments of the present invention.

Reference is now made to FIG. 7, which is a block diagram illustrating methods of using a self-locking coaxial connector. Embodiments of such methods include compelling a prepared end of a coaxial cable in an axial direction into a first end of the coaxial connector to position one or more elements of the coaxial cable between a sliding compression element tapered surface and a connector body tapered surface (block 320). Embodiments may include applying an axially directed force to the coaxial cable that is directed away from the coaxial connector to cause the one or more elements of the coaxial cable to be compressed between the sliding compression element tapered surface and the connector body tapered surface via the axial motion of the sliding compression element tapered surface.

In the drawings and specification, there have been disclosed typical embodiments of the invention and, although specific terms are employed, they are used in a generic and descriptive sense only and not for purposes of limitation, the scope of the invention being set forth in the following claims.

That which is claimed is:

1. A coaxial connector, comprising:

a connector body including a first connector body opening for receiving a coaxial cable;

a tubular inner contact post that is at least partly within the connector body; and a sliding compression element that is configured to impart a compressive force to secure one or more elements of the coaxial cable between the sliding compression element and the connector body when an axially directed force that is directed away from the connector body is applied to the coaxial cable.

2. The coaxial connector of claim 1, wherein the sliding compression element is further configured to limit the compressive force to one or more non-core elements of the coaxial cable.

3. The coaxial connector of claim 1, wherein the sliding compression element comprises an inner surface that is configured to axially moveably engage an outer surface of the tubular inner contact post.

4. The coaxial connector of claim 1, wherein the compressive force comprises a generally circumferential compressive force.

5. The coaxial connector of claim 1, further comprising a mechanical fastening element that includes an internal threaded portion, that is attached proximate a second connector body opening that is opposite the first connector body opening in a rotationally independent manner relative to the connector body and that is configured to be rotationally engaged with a complementary external threaded portion of another connector.

6. The coaxial connector of claim 1, wherein the sliding compression element comprises a wedge portion that is configured to apply circumferential pressure to the one or more elements of the coaxial cable in a radially outward direction.

7. The coaxial connector of claim 6, wherein the wedge portion comprises a radially consistent wedge that includes a compression element opening that is configured to receive a first portion of the coaxial cable, wherein the wedge portion includes an outer surface that is configured to engage a second portion of the coaxial cable when the compression element opening receives the first portion of the coaxial cable.

8. The coaxial connector of claim 1, wherein the sliding compression element comprises an inside surface and an outside surface, wherein the outside surface includes a first compression surface including a variable distance from an axially oriented centerline of the connector and the inside surface is configured to receive the inner contact post in a slidable engagement.

9. The coaxial connector of claim 8, wherein the compression surface comprises a first end that is a first distance from the axially oriented centerline that corresponds to the first connector body opening and a second end that is a second distance from the axially oriented centerline, wherein the first distance is less than the second distance.

10. The coaxial connector of claim 8, wherein the variable distance is substantially linear and includes a cross-sectional profile that defines a retention surface angle relative to the axially oriented centerline.

11. The coaxial connector of claim 10, where the retention surface angle comprises about 5 to about 15 degrees relative to the axially oriented centerline.

12. The coaxial connector of claim 8, wherein the connector body comprises a second compression surface that is configured to be substantially parallel to the first compression surface to define a cable retention gap, wherein when the first connector body opening receives the coaxial cable, the sliding compression element is configured to slide away from the first connector body opening to increase the cable retention gap and the one or more elements of the coaxial cable are compelled between the first compression surface and the second compression surface, and wherein when the axially directed force that is directed away from the connector body is applied to the coaxial cable, the sliding compression element is configured to slide towards the first connector body opening to decrease the cable retention gap.

13. The coaxial connector of claim 8, wherein the sliding compression element further comprises a plurality of radially oriented slots in at least a portion of the first compression surface.

14. The coaxial connector of claim 8, wherein the inside surface of the sliding compression element comprises a stopping surface that is configured to limit the movement of the sliding compression element in a direction away from the first connector body opening.

15. The coaxial connector of claim 8, wherein the sliding compression element is entirely within the connector body.

16. A coaxial connector, comprising:

a connector body; and a sliding compression element located within the connector body and configured to impart a compressive force to secure one or more elements of a coaxial cable between a sliding compression element tapered outer surface and a connector body tapered inner surface when an axially directed force that is directed away from the connector body is applied to the coaxial cable.

17. The coaxial connector of claim 16, wherein the sliding compression elements is further configured to limit the compressive force to one or more non-core elements of the coaxial cable.

18. The coaxial connector of claim 16, wherein the sliding compression element comprises a plurality of radially oriented slots in at least a portion of the sliding compression element tapered surface.

19. The coaxial connector of claim 16, wherein the sliding compression element comprises an inner surface that is configured to receive a first portion of the coaxial cable and wherein the tapered surface is configured to engage the one or more elements of the coaxial cable that are different from the first portion of the coaxial cable.

20. The coaxial connector of claim 16, further comprising a tubular inner contact post that includes a contact inner surface that is configured to receive the first portion of the coaxial cable and a contact outer surface that is configured to receive the sliding compression element, wherein the sliding compression element is configured to slide relative to the tubular inner contact post.

21. The coaxial connector of claim 20, wherein the sliding compression element comprises a stopping surface that is configured to engage a portion of the tubular inner contact post to limit travel of the sliding compression element relative to the tubular inner contact post.

22. The coaxial connector of claim 16, further comprising a mechanical fastening element that is configured to be engaged with a complementary portion of another connector.

23. The coaxial connector of claim 16, wherein the sliding compression element tapered outer surface comprises a surface angle that is about 5 to about 15 degrees relative to an axially oriented centerline.

24. A method of using a coaxial connector, the method comprising:

inserting a prepared end of a coaxial cable in an axial direction into a first end of the coaxial connector to position one or more elements of the coaxial cable between a tapered surface of a sliding compression element and a tapered surface of a connector body; and applying an axially directed force to the coaxial cable that is directed away from the coaxial connector to cause the one or more elements of the coaxial cable to be compressed between the tapered surface of the sliding compression element and the tapered surface of the connector body via the axial motion of the sliding compression element.

25. The method of using the coaxial connector according to claim 24, wherein the one or more elements of the coaxial cable comprise non-core elements of the coaxial cable, and wherein a core section of the coaxial cable is not compressed.

* * * * *